US012234817B2

(12) United States Patent
Alharbi

(10) Patent No.: US 12,234,817 B2
(45) Date of Patent: Feb. 25, 2025

(54) METERING POSITIVE DISPLACEMENT PUMP STROKE LENGTH LIMITER

(71) Applicant: SAUDI ARABIAN OIL COMPANY, Dhahran (SA)

(72) Inventor: Ahmad Hamad Alharbi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 133 days.

(21) Appl. No.: 18/302,633

(22) Filed: Apr. 18, 2023

(65) Prior Publication Data

US 2024/0352928 A1 Oct. 24, 2024

(51) Int. Cl.
*F04B 49/12* (2006.01)
*F04B 13/00* (2006.01)

(52) U.S. Cl.
CPC ..... *F04B 49/12* (2013.01); *F04B 13/00* (2013.01)

(58) Field of Classification Search
CPC ..... F04B 13/10; F04B 49/12; F04B 49/121; B05B 11/1007
USPC ..... 417/214, 218
See application file for complete search history.

(56) References Cited

U.S. PATENT DOCUMENTS 5,279,504 A * 1/1994 Williams ..... F04B 43/06 417/393
6,164,924 A * 12/2000 Gruett ..... F04B 13/00 417/415

FOREIGN PATENT DOCUMENTS

AU 2012332382 B2 5/2013
GB 2589953 A 6/2021

OTHER PUBLICATIONS

Operating Instructions Manual for "H" Series Dosing Pump; retrieved from https://watsanmissionassistant.org/wp-content/uploads/2018/10/dosing-pump-manual.pdf (2023).
Milroyal "G" Pump Instruction Manual retrieved from https://www.ewprocess.com/wp-content/uploads/Milroyal-G-Pump-Manual.pdf (2023).
Roytronic Excel, Series AD9 Programming Guide Electronic Metering Pumps Instruction Manual, retrieved from https://irp-cdn.multiscreensite.com/cef7f711/files/uploaded/AD9%20Porgramming%20Guide%20-%202032D.pdf.

* cited by examiner

*Primary Examiner* — Kenneth J Hansen
(74) *Attorney, Agent, or Firm* — Vorys, Sater, Seymour and Pease LLP

(57) ABSTRACT

A system includes a metering positive displacement pump including a body, a stroke adjustment shaft and a stroke adjustment knob, the stroke adjustment knob operable to translate axially with respect to the body to set a stroke length of the metering positive displacement pump. The system further includes a limiter having a hollow body with an axial slot defined across the hollow body, the limiter having a predetermined length corresponding to a minimum permissible stroke length of the metering positive displacement pump, wherein the limiter is installed over the stroke adjustment shaft of the metering positive displacement pump, and wherein axial translation of the stroke adjustment knob towards the body of the metering positive displacement pump is limited by the limiter to prevent setting the stroke length below the minimum permissible stroke length.

15 Claims, 3 Drawing Sheets

METERING POSITIVE DISPLACEMENT PUMP STROKE LENGTH LIMITER

FIELD OF THE DISCLOSURE

The present disclosure relates generally to metering pump operation and, more particularly, to an apparatus for physically locking or limiting stroke length in a metering positive displacement pump.

BACKGROUND OF THE DISCLOSURE

While using rotary or centrifugal pumps in industry processes, the most common and preferred method of sealing pumps is to employ mechanical seals. Knowledge accumulated from manufacturers and end users of these mechanical seals has been used by the American Petroleum Institute (API) to create a series of API piping plans for maintaining the mechanical seals for pumps. Some API piping plans, such as API Plan 53B (with external seal flush), may require pressurization in a particular amount of time to avoid possible pump trip due to low pressure. In such applications, metering Positive Displacement (PD) pumps may be utilized as make-up units, which provide supplemental fluid to a barrier fluid system (e.g., API 53B) to ensure adequate supply and pressure to make-up for leaked or degraded circulated fluid. Any failure to timely provide adequate supply fluid to the system may result in low pressure in the seal circuit, which may trip a pump (e.g., the pump may encounter an unplanned emergency shutdown) within the system and cause costly downtime and production loss. As such, the metering PD pumps may require a stroke length greater than or equal to a threshold which must be maintained to provide adequate supply fluid to the system.

A metering PD pump may be equipped with a manual stroke adjustment knob, which may enable an operator to manually set the stroke length of the metering PD pump in order to output a target flow amount corresponding to the stroke length. In order to prevent human error during setting of the manual stroke adjustment knob or unintentional setting/changing of the pump stroke, several mechanical and electrical methods are used for locking or limiting the metering PD pumps' stroke, such as remotely controlling the pump stroke lock from a control room or other remote location. However, these mechanical and electrical methods and mechanisms may be complicated, require frequent maintenance and, if not well maintained, they may be susceptible to failure. For PD pumps lacking a stroke locking or limiting mechanism, the addition of a conventional mechanical or electrical mechanism may require modification to the pumps. These pump modifications may be infeasible for the pump's application and may introduce additional costs. Further, inadequate maintenance of installed mechanical and electrical mechanisms may result in system functional failure of the pump leading to system trip, thus prompting further downtime and costly maintenance.

Accordingly, a reliable, easily implemented, and ready-to-use method of limiting or locking the stroke length of a metering PD pump is desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system includes a metering positive displacement pump including a body, a stroke adjustment shaft and a stroke adjustment knob, the stroke adjustment knob operable to translate axially with respect to the body to set a stroke length of the metering positive displacement pump. The system further includes a limiter having a hollow body with an axial slot defined across the hollow body, the limiter having a predetermined length corresponding to a minimum permissible stroke length of the metering positive displacement pump. The limiter is installed over the stroke adjustment shaft of the metering positive displacement pump, and the axial translation of the stroke adjustment knob towards the body of the metering positive displacement pump is limited by the limiter to prevent setting the stroke length below the minimum permissible stroke length.

In another embodiment, a method includes determining a minimum permissible stroke length of a metering positive displacement pump for operation within a system, determining a shaft length of a stroke adjustment shaft of the metering positive displacement pump corresponding to the minimum permissible stroke length, locating a limiter with a selected length matching the shaft length corresponding to the minimum permissible stroke length, and installing the limiter on the metering positive displacement pump such that an adjustment knob is prohibited from traveling beyond a setting corresponding to the minimum permissible stroke length setting by the limiter.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
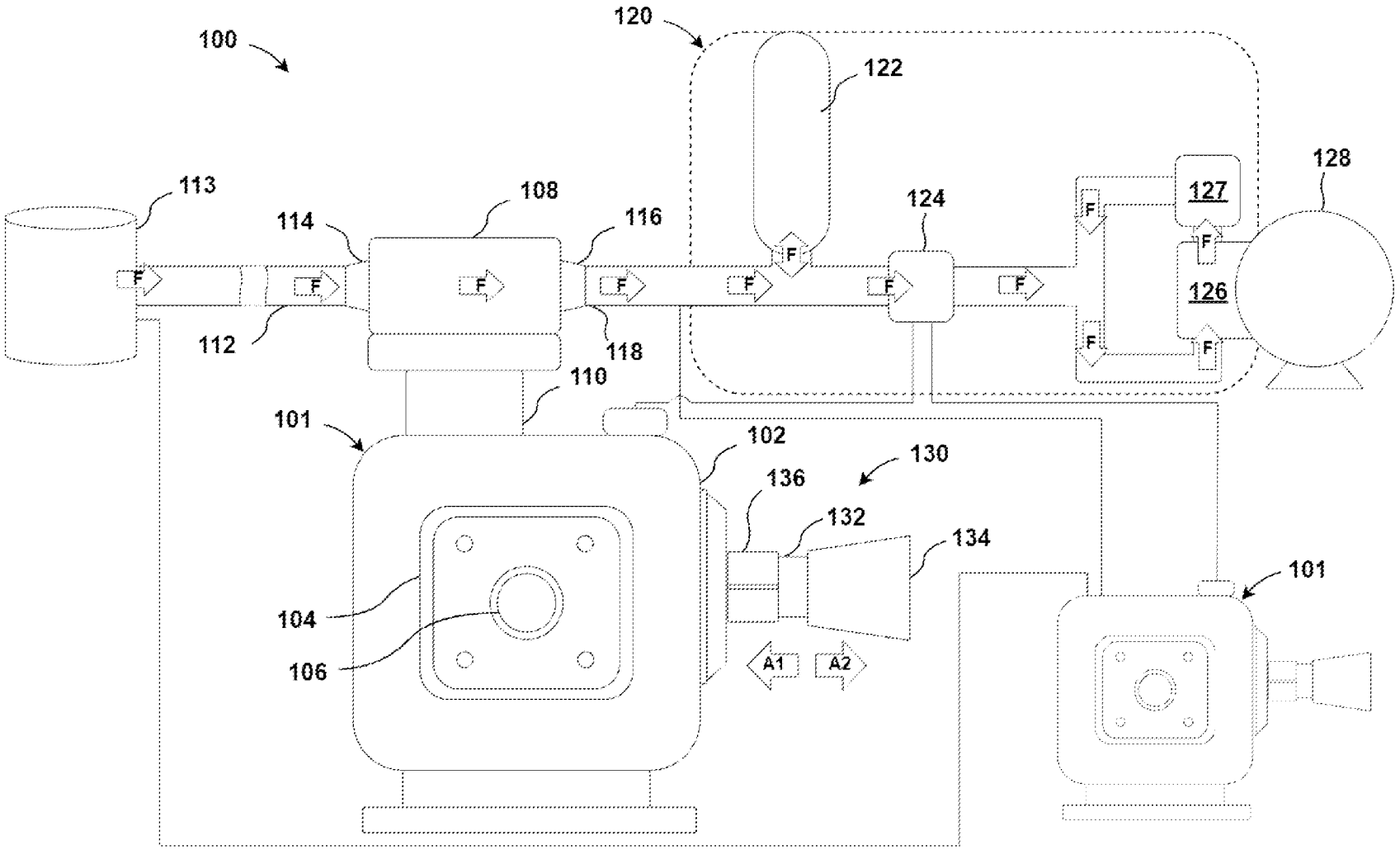
FIG. 1 is a schematic side view of an example mechanical seal system including a barrier fluid and a metering positive displacement pump with a limiter installed on a manual stroke adjustment assembly thereof in accordance with embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to metering pump operation and, more particularly, to an apparatus for physically locking or limiting stroke length in a metering positive displacement pump. The embodiments disclosed herein describe a limiter which may be installed on a metering positive displacement pump such that a minimum permissible stroke length is ensured. The limiter described herein may be formed of a low-cost material, may require little maintenance, and may be installed without modifications to the rest of the system. The limiter described herein may prevent shutdowns or system failures due to underflow, such that the metering positive displacement pumps may be locked or limited to a minimum permissible stroke length. Further, the limiter described herein may be located, designed and/or fabricated prior to operation, or may be designed and fabricated during system operation without special equipment or materials.

FIG. 1 is a schematic side view of an example mechanical seal system 100 including a metering positive displacement (PD) pump 101. The metering PD pump 101 (hereinafter "the PD pump 101") may be operable to facilitate maintenance of a mechanical seal 126 associated with a system pump 128. As illustrated in FIG. 1, the mechanical seal system 100 may include two PD pumps 101 coupled in parallel, as a primary and standby PD pumps 101 to ensure reliable operation of the make-up process. If one PD pump 101 fails or suffers an outage, or if additional pressure and flow is necessary to restore abnormally low pressure condition of the mechanical seal system 100, the second PD pump 101 may enable reliable operation. The two PD pumps 101 may operate in substantially similar manners, and thus, the operation of only one of the PD pumps 101 is described in detail.

The PD pump 101 may include a body 102 which houses internal components for fluid pumping. For example, the body 102 may house a pumping element (e.g., a piston, a plunger, or a diaphragm) for positive displacement of a barrier fluid "F." The body 102 may define a drive interface 104 on a face of the body 102, such that a drive mechanism (not shown) may be mounted and mated to the body 102 for providing rotational energy to the PD pump 101. The drive mechanism may be coupled to an axle 106 which may protrude from, or extend through, the drive interface 104. In some embodiments, the drive mechanism may be a motor coupled to the axle 106, such that the motor may drive rotation of the internal components of the PD pump 101.

Rotation of the internal components of the PD pump 101 may induce the barrier fluid "F" to be pumped through a flow chamber 108 that is mated to the PD pump 101. The flow chamber 108 may be mounted on, or mated to, a pumping element housing 110 that contains the pumping element (e.g., the piston, plunger or diaphragm) and extends from the body 102 of the PD pump 101. The pumping element housing 110 may provide pressure to the fluid inside the flow chamber 108 by the reciprocating action of the pumping element, such that flow may occur across the flow chamber 108. The pumping element housing 110 represents the interface between the PD pump 101 and the fluid flowing inside the flow chamber 108 such that at least some portion of the pumping element housing 110 is in fluid communication with the flow chamber 108.

During operation of the PD pump 101, barrier fluid "F" may be supplied via an inlet line 112 in fluid communication with a fluid supply 113 of the barrier fluid "F". The inlet line 112 may be mated to the flow chamber 108 via an inlet valve 114. The inlet valve 114 may be a one-way valve which is actuatable to open when pressure decreases in the flow chamber 108, such that a pressure differential is created across the inlet valve 114. In some embodiments, the pressure decrease in the flow chamber 108 corresponds to a suction stroke of the PD pump 101. Barrier fluid "F" from the inlet line 112 may fill the flow chamber 108 and pressure may increase within the flow chamber 108. In some embodiments, the pressure increase in the flow chamber 108 corresponds to a compression stroke of the PD pump 101. As pressure increases within the flow chamber 108, the inlet valve 114 may close and an outlet valve 116 may open. The outlet valve 116 may be of similar construction to the inlet valve 114, and may operate to maintain one-way flow of the barrier fluid "F". The opening of the outlet valve 116 may enable fluid to flow from the flow chamber 108 into an outlet line 118.

The outlet line 118 may carry the barrier fluid "F" to a barrier fluid system 120, which may include an accumulator 122. The accumulator 122 may contain a bladder pre-filled with a fluid, which typically includes nitrogen. The accumulator 122 may maintain pressurization of the barrier fluid "F" in the barrier fluid system 120. As the pressure of the barrier fluid "F" reaches a low pressure threshold value, the PD pumps 101 may provide additional barrier fluid "F" to pressurize and restore the normal pressure in the accumulator 122. In some embodiments, additional accumulators 122 may be provided along the outlet line 118 to maintain the pressure in the barrier fluid "F" makeup system lines (e.g., outlet line 118). The barrier fluid system 120 may further include one or more sensors 124, which may include pressure sensors and temperature sensors. The sensors 124 are operable for monitoring the barrier fluid "F" within the barrier fluid system 120, and are operably coupled to (e.g., in communication with) the two PD pumps 101. As described in greater detail below, the PD pumps 101 may be operated in response to the detection of a pressure of the barrier fluid "F" below one or more predetermined thresholds.

The barrier fluid system 120 may circulate the barrier fluid "F" through the mechanical seal 126, which may include a rotary seal of the system pump 128, for example. In some embodiments, the system pump 128 may pump a hazardous material such as a hydrocarbon, acid or corrosive chemicals. The pressurized barrier fluid "F" may provide a secondary barrier within the mechanical seal 126, as outlined in API Plan 53B to prevent leakage of any hazardous materials from the system pump 128. The barrier fluid "F" may include non-flammable chemically inert fluids that will not adversely interact with the fluids/materials passing through the system pump 128. The barrier fluid "F" may further cool and lubricate the mechanical seal 126. A cooler 127 may be provided to cool the barrier fluid "F" after passing through the mechanical seal 126.

Where the seal barrier fluid system 120 is employed for an external flush plan of the mechanical seal 126, such as API 53B, the seal barrier fluid system 120 may require a minimum flow rate or pressure. The barrier fluid system 120 may require the barrier fluid "F" to be circulated with a certain pressure that is recommended by a supplier of the mechanical seal 126. The barrier fluid pressure may decrease as a result of leakage from the mechanical seal 126 during normal operations, or as a result of increased leakage from seal failure. If the one or more sensors 124 detect a pressure below a first threshold, an instruction signal may be transmitted to a first one of the PD pumps 101 to instruct that PD pump 101 to operate. The first PD pump 101 may restore the pressure of the barrier fluid system 120. If, however, the one or more sensors 124 detect that the pressure continues to fall below a second predetermined threshold, an instruction signal may be transmitted to a second one of the PD pumps 101 to instruct that second PD pump 101 to operate until the pressure within the barrier fluid system 120 is restored.

If the PD pumps 101 fail to pressurize the barrier fluid system 120 due to inadequate flow that cannot accommodate for or cope with the rate of system pressure decrease (or the leakage flow rate), the pressure in the mechanical seal 126 may reach a shutdown point and lead to process trip. For example, if the one or more sensors 124 detect a pressure drop below a third threshold while both PD pumps 101 are operating, a signal may be transmitted to the system pump 128 to initiate a trip or shutdown. Therefore, the PD pumps 101 may have a minimum flow rate required to timely restore and maintain the barrier fluid system 120 and the pressure of the mechanical seal 126 to a normal condition recommended by the designer or supplier in order to prevent equipment tripping and system shutdown.

The minimum flow rate of the PD pumps 101 may be determined relative to the barrier fluid system 120 and the employed seal plan, as well as the length, profile, and properties of the interconnecting piping. In some embodiments, the recommended flow rate may be indicated by the supplier of the PD pumps 101. In these embodiments, the minimum flow rate may be set to a marginally greater value to account for increased leakage cases or an abnormally low pressure (second threshold pressure value) of the barrier fluid system 120, such as about 20% greater than the recommended flow rate. In alternate embodiments, the minimum flow rate may be determined through experimentation, which may be performed during pre-commissioning or during any instance of equipment shutdown. In these embodiments, the stroke of the PD pumps 101 may be set at 60% of the maximum stroke length, and the barrier fluid system 120 and mechanical seal 126 may be drained to reach to the system low pressure setting as defined by the supplier. The time taken to pressurize the barrier fluid system 120 and mechanical seal 126 to normal operating conditions may then be measured. Depending upon the time taken to pressurize the barrier fluid system 120 or mechanical seal 126, the stroke of the PD pumps 101 may be maintained between about 60% and about 80%. However, if the barrier fluid system 120 or mechanical seal 126 are not pressurized in a timely manner, such as in about 2 seconds to about 3 seconds or more than a time delay programmed into shutdown logic to trip the system pump 128, the stroke of the PD pumps 101 may be further increased.

Accordingly, as the PD pumps 101 operate to draw barrier fluid "F" from the inlet line 112 and output the barrier fluid "F" into the outlet line 118, the flow (i.e., the stroke or displaced volume) of the PD pumps 101 may be controlled by a stroke adjustment assembly 130. The internal components within the body 102 may include one or more eccentric gears, shafts, or slots, which variably mate the axle 106 with the piston, plunger, or diaphragm of the pumping element housing 110. These components may enable the stroke of the PD pump 101 to be adjusted and controlled by the stroke adjustment assembly 130.

In the illustrated embodiment, the stroke adjustment assembly 130 includes a stroke adjustment shaft 132 protruding from the body 102. The stroke adjustment shaft 132 may be mated to a stroke adjustment knob 134 which may travel over the stroke adjustment shaft 132 to control the stroke length of the PD pump 101. In alternate embodiments, however, the stroke adjustment shaft 132 may travel in and out of the body 102 in response to motion of the stroke adjustment knob 134. In the illustrated embodiment, axial movement of the stroke adjustment knob 134 towards the body 102 (in the direction of arrow A1) will decrease a stroke length of the PD pump 101 and withdrawing the stroke adjustment knob 134 axially away from the body 102 (in the direction of arrow A2) will increase the stroke length of the PD pump 101. The stroke adjustment shaft 132 or stroke adjustment knob 134 may directly affect the one or more eccentric gears, shafts, or slots, such that the stroke length may be increased or decreased. The adjustment of the stroke length may directly correlate to an increase or decrease in flow per stroke of the PD pump 101.

In some embodiments, the stroke adjustment shaft 132 may define one or more visual markers (not shown) to denote the stroke length for each position of the stroke adjustment shaft 132. The minimum flow rate may correspond to a minimum allowable stroke length of the PD pump 101, and therefore a minimum position setting of the stroke adjustment shaft 132. The minimum position setting for each of the PD pumps 101 should be set based on the first threshold low pressure value and increased by a margin of 20% to account for the increased leakage or the abnormal condition of the second threshold low pressure value. Hence, each PD pump 101 may independently accommodate for the full system requirements. This redundancy may enable reliability and availability of the mechanical seal system 100 through multiple PD pumps 101 (i.e., primary and standby) and to enable one PD pump 101 to adequately supply the system in case of the failure or outage of another PD pump 101.

The under-setting of the stroke adjustment shaft 132 via the stroke adjustment knob 134 may result in system failure or downtime as the PD pumps 101 may fail to provide adequate fluid supply to the system. As such, the PD pumps 101 may each be equipped with a limiter 136 installed over the stroke adjustment shaft 132. The limiter 136 may be installed around the stroke adjustment shaft 132 such that the stroke adjustment knob 134 cannot travel past a predefined position. In some embodiments, the limiter 136 may act as a car-seal for physically preventing any change to the stroke length of the PD pump 101 due to unintentional or unauthorized human intervention. Through prevention of travel of the stroke adjustment knob 134 past a selected position, the limiter 136 may define the minimum permissible stroke length of the PD pump 101 as the stroke adjustment shaft 132 will be similarly limited in travel.

Figure 2:
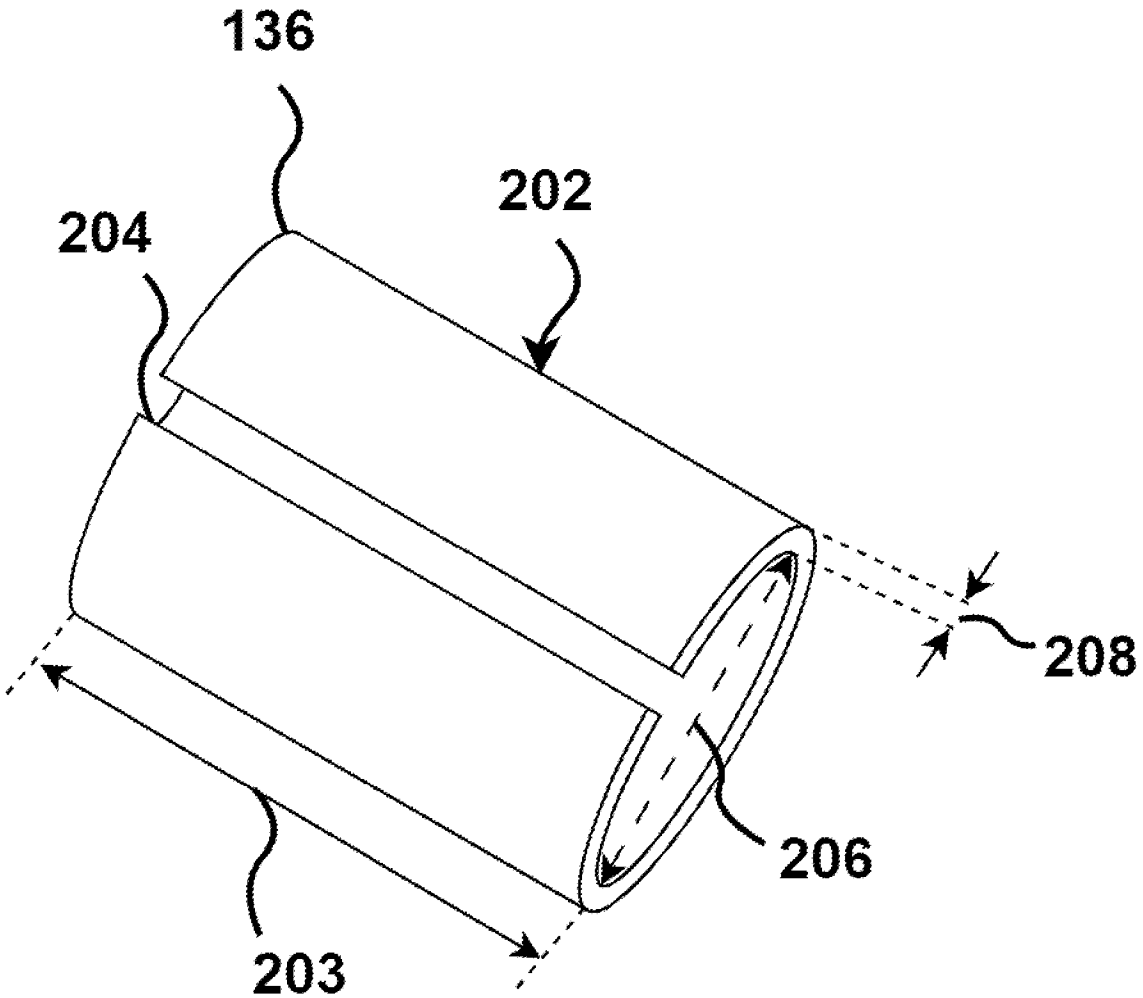
FIG. 2 is a perspective view of the limiter of FIG. 1.

FIG. 2 is a perspective view of an example of the limiter 136, according to at least one embodiment of the present disclosure. The limiter 136 may define a generally cylindrical body 202 of a selected length 203 for limiting manual stroke adjustment. In some embodiments, however, the limiter 136 may define a body of a non-cylindrical shape without departing from the scope of this disclosure. The selected length 203 for limiting manual stroke adjustment may range from about 60% to about 80% of the total stroke length in order to secure the adequate required flow. The selected length 203 for the limiter 136 on each PD pump 101 (FIG. 1) may be the same or different according to the requirements of the barrier fluid system 120 (FIG. 1). For example, the limiter 136 on the second PD pump 101 may be longer than the limiter 136 on the first PD pump 101. In some embodiments, however, the selected length 203 for both PD pumps 101 are of the same size to enable one PD pump 101 to fully pressurize the attached system during failure or outage of the other PD pump 101.

The cylindrical body 202 may include a slot 204 which may enable clastic deformation of the cylindrical body 202 to fit over the stroke adjustment shaft 132 of FIG. 1. As illustrated, the slot 204 may extend between opposing ends of the cylindrical body 202. The cylindrical body 202 may be hollow such that an interior diameter 206 is defined, which may house the stroke adjustment shaft 132 (FIG. 1) after installation. The cylindrical body 202 may have a thickness 208 which may allow for clastic deformation of the cylindrical body 202 while maintaining a desired structural integrity. In some embodiments, the thickness 208 may be greater than or equal to a minimum thickness of about 3 millimeters. The thickness 208 may be further increased up to about 7 millimeters, depending on the interior diameter 206, such that the integrity may be maintained along with flexibility of the limiter body for the installation and re-installation.

The limiter 136 may be formed of any material which may elastically deform to be received over the stroke adjustment shaft 132 (FIG. 2), while returning to the shape of the cylindrical body 202 once received over stroke adjustment shaft 132. In some embodiments, the limiter 136 may be formed of a thermoplastic or an ultraviolet-resistant plastic material such that the limiter 136 may be cheaply manufactured while resisting breakdown due to exposure to ultraviolet light for durability. In some embodiments, the limiter 136 may be formed of a brightly-colored plastic for easier visual recognition by an operator, such that the operator may verify limiting of the PD pump 101 of FIG. 1. The limiter 136 may be installed before or during system operation and may not require any modifications for installation or use. The limiter 136 may not require any maintenance and may not be susceptible to failure, unlike traditional methods of limiting the PD pump 101 of FIG. 1 which may include mechanical (e.g., screw/thread assisted) or electrical/electronic mechanisms.

Figure 3:
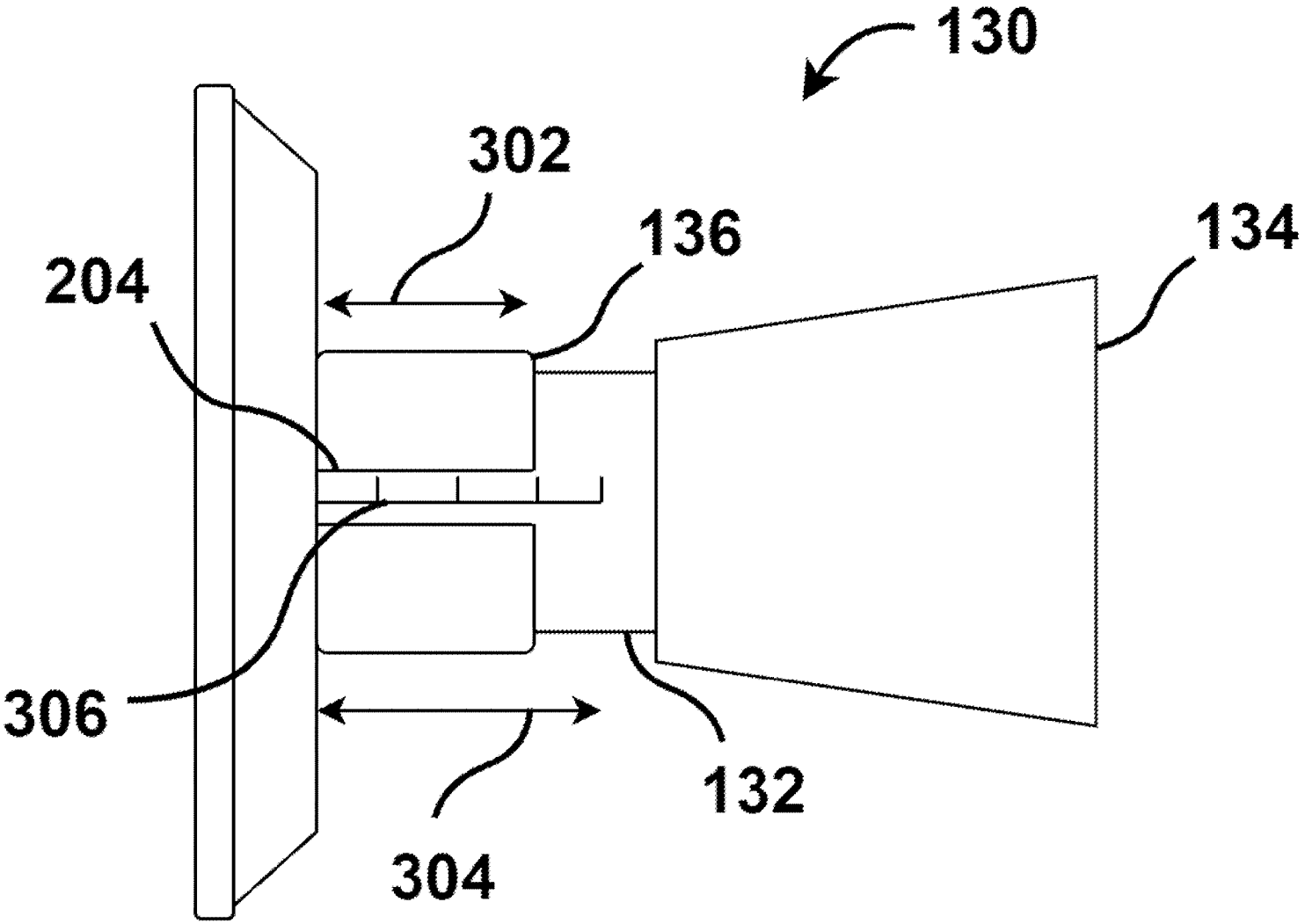
FIG. 3 is a schematic side view of the manual stroke adjustment assembly with the installed limiter.

FIG. 3 is a schematic side view of the manual stroke adjustment assembly 130 with the installed limiter 136. The limiter 136 may have been elastically deformed such that the slot 204 was expanded to extend over (accept) the stroke adjustment shaft 132. After fully accepting the stroke adjustment shaft 132 through the slot 204, the limiter 136 may return to the original shape and the cylindrical body 202 may surround the stroke adjustment shaft 132 as shown in FIG. 3.

In the illustrated embodiment, the slot 204 may be situated around the rear of the stroke adjustment shaft 132. In some embodiments, the limiter 136 may be uninstalled during maintenance or for cycling to a new limiter. The process of uninstalling the limiter 136 similarly involves elastic deformation of the limiter 136 and expansion of the slot 204 to remove the limiter 136 from the stroke adjustment shaft 132. In alternate embodiments, the stroke adjustment knob 134 may be removed from the manual stroke adjustment assembly 130 and the limiter 136 may be slid onto the stroke adjustment shaft 132. In these alternate embodiments, the limiter 136 may not require elastic deformation and may be formed of metals, ceramics, or any other rigid material.

The limiter 136 may be sized such that the selected length 203 (FIG. 2) of the limiter 136 matches a first distance 302 along the stroke adjustment shaft 132 that represents the minimum permissible stroke length determined for the attached system. The minimum permissible stroke length may correspond to a minimum flow rate output permissible for one or both of the PD pumps 101 of FIG. 1 in order to pressurize a system in a certain amount of time. With the limiter 136 installed over the stroke adjustment shaft 132, the stroke adjustment knob 134 may no longer travel past the limiter 136 and is effectively locked with a minimum permissible stroke length corresponding to the first distance 302. It should be noted, however, that the stroke adjustment knob 134 is free to axially travel away from the limiter 136. As such, the limiter 136 may define a minimum permissible stroke length corresponding to the first distance 302 while enabling travel to a second distance 304 corresponding to a maximum stroke length defined by the stroke adjustment shaft 132. In at least one embodiment, the first distance 302 may be about 60% of the second distance 304, such that the minimum permissible stroke length is about 60% of the maximum stroke length to prevent underflow to the system. In some embodiments, the stroke adjustment shaft 132 may define one or more visual markers 306 which denote stroke length based upon position of the stroke adjustment knob 134.

In some embodiments, the stroke adjustment knob 134 may be un-limited (without a limiter 136 installed) during operation and may require deployment of a limiting mechanism. In these embodiments, the first distance 302 corresponding to the minimum permissible stroke length which will produce the minimum flow rate required to timely pressurize the system, as determined from the makeup system supplier/designer recommendations or through simulating the low pressure scenario during system pre-commissioning or shutdown. In the specifications of a PD pump, a pump manufacturer may indicate a flow rate corresponding to the second distance 304 with the maximum flow rate when the stroke adjustment knob 134 travels the second distance 304. Hence, the first distance 302 may be a percentage of the second distance 304 measured as the ratio of the minimum flow to the maximum flow. In some cases, the limiter 136 may be located as needed. In such embodiments, an operator may purchase a component part capable or operating as the limiter 136, or may alternatively find scrap material that may be capable or operating as the limiter 136. In other embodiments, however, the limiter 136 may be designed and fabricated at a worksite during operation using available materials. As such, the design, fabrication, and installation of the limiter 136 may occur during standard operations without the need for modifications to the PD pump 101 of FIG. 1 or the sourcing of special materials or equipment. Further, the limiter 136 may be utilized in remote facilities which are frequently unattended, as the lack of maintenance requirements enable long-term use of the limiter 136 without degradation or failure.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system comprising:

a metering positive displacement pump including a body, a stroke adjustment shaft and a stroke adjustment knob, the stroke adjustment knob operable to translate axially with respect to the body to set a stroke length of the metering positive displacement pump; and a limiter having a hollow body with an axial slot defined across the hollow body, the limiter having a predetermined length corresponding to a minimum permissible stroke length of the metering positive displacement pump, wherein the limiter is installed over the stroke adjustment shaft of the metering positive displacement pump, and wherein axial translation of the stroke adjustment knob towards the body of the metering positive displacement pump is limited by the limiter to prevent setting the stroke length below the minimum permissible stroke length.

2. The system of claim 1, wherein the system further comprises a flow chamber pressurized by the metering positive displacement pump, and wherein the flow chamber is in fluid communication with an inlet line and outlet line.

3. The system of claim 2, wherein the outlet line is in fluid communication with a barrier fluid system, and wherein the minimum permissible stroke length defined by the limiter is based on a parameter of a mechanical seal and the barrier fluid system.

4. The system of claim 1, wherein the hollow body of the limiter is of a thickness from about 3 millimeters to about 7 millimeters.

5. The system of claim 1, wherein the predetermined length of the limiter corresponds to about 60% of a maximum stroke length setting on the stroke adjustment shaft.

6. The system of claim 1, wherein the limiter is formed of an elastically-deformable material.

7. The system of claim 6, wherein the elastically-deformable material is an ultraviolet-resistant plastic or thermoplastic material.

8. The system of claim 7, wherein the ultraviolet-resistant plastic or thermoplastic material is brightly-colored, and wherein the limiter is a visual marker that the metering positive displacement pump is limited.

9. The system of claim 8, wherein the hollow body of the limiter is a cylindrical body.

10. A method comprising:

determining a minimum permissible stroke length of a metering positive displacement pump for operation within a system;

determining a shaft length of a stroke adjustment shaft of the metering positive displacement pump corresponding to the minimum permissible stroke length;

locating a limiter having a hollow body with an axial slot defined in the hollow body with a selected length matching the shaft length corresponding to the minimum permissible stroke length; and installing the limiter on the metering positive displacement pump such that an adjustment knob is prohibited from traveling beyond a setting corresponding to the minimum permissible stroke length setting by the limiter.

11. The method of claim 10, wherein installing the limiter comprises:

elastically deforming the hollow body of the limiter to enlarge the slot axially defined in the hollow body;

inserting the stroke adjustment shaft of the metering positive displacement pump through the slot; and returning the hollow body of the limiter to an original shape around the stroke adjustment shaft.

12. The method of claim 11, further comprising:

removing the stroke adjustment shaft from the slot by elastically deforming the hollow body of the limiter to enlarge the slot axially defined in the hollow body; and returning the hollow body of the limiter to the original shape separate from the stroke adjustment shaft.

13. The method of claim 10, wherein locating the limiter comprises fabricating the limiter by shaping the limiter from an elastically-deformable, ultraviolet-resistant plastic or thermoplastic material.

14. The method of claim 13, wherein fabricating the limiter further includes shaping the elastically-deformable, ultraviolet-resistant plastic or thermoplastic material to a thickness from about 3 millimeters to about 7 millimeters.

15. The method of claim 10, wherein locating the limiter comprises fabricating the limiter includes forming the limiter such that the selected length is about 60% to about 80% of a maximum stroke length defined by the stroke adjustment shaft.

* * * * *